United States Patent [19]

Janoski

[11] 4,270,455

[45] Jun. 2, 1981

[54] BLASTING CAP BOOSTER ASSEMBLY

[75] Inventor: Florian B. Janoski, Allentown, Pa.

[73] Assignee: Atlas Powder Company, Dallas, Tex.

[21] Appl. No.: 273

[22] Filed: Jan. 2, 1979

[51] Int. Cl.[3] ..... C06C 7/00

[52] U.S. Cl. ..... 102/318; 102/202.5; 102/275.9

[58] Field of Search ..... 102/24 R, 28 R, 29, 102/30

[56] References Cited

U.S. PATENT DOCUMENTS

| | | | |
|---|---|---|---|
| Re. 28,228 | 11/1974 | Graham | 102/29 |
| 2,428,884 | 10/1947 | Lefren | 102/30 |
| 2,617,326 | 11/1952 | Morris | 102/29 |
| 2,726,602 | 12/1955 | Davis et al. | 102/29 |
| 2,878,752 | 3/1959 | Johnson et al. | 102/28 R |
| 3,401,632 | 9/1968 | Griffith et al. | 102/24 R |
| 4,170,178 | 10/1979 | Diewald | 102/29 |

*Primary Examiner*—Edward A. Miller

*Attorney, Agent, or Firm*—Richards, Harris & Medlock

[57] ABSTRACT

An explosive booster cap containing a confined detonable charge, said confinement providing a high degree of water protection for said detonable charge, but which confinement will, when the booster cap is subjected to a fire or excessive heat, be disrupted to allow for outgassing and burning of the detonable charge without explosion. Confinement of the detonable charge is provided by a thermoplastic plug inserted into the open end of the booster cap. The physical properties of the thermoplastic plug permit the plug to deform when heated to a temperature between the decomposition and initiation temperatures of the explosive. The booster cap is slipped over the detonable end of the blasting cap, the resultant combination providing a substantially enhanced explosive output.

13 Claims, 3 Drawing Figures

BLASTING CAP BOOSTER ASSEMBLY

BACKGROUND OF THE INVENTION

No. 6 or No. 8 blasting caps have been reliably used for many years as initiators for nitroglycerin based dynamite. However, with comparatively insensitive explosives, a No. 6 or No. 8 cap does not initiate the explosive. Such is the case with the most common industrial explosive, ANFO (ammonium nitrate/fuel oil). Other insensitive explosives include many of the relatively new gels and emulsions. The need for a reliable method of detonating comparatively insensitive explosives was partially met with the advent of the booster cap, which is used to enhance the output of the blasting cap and is initiated by the blasting cap.

The explosives industry has sought a booster cap which would be impervious to water desensitization and dudding, and shippable under U.S. Department of Transportation (DOT) Explosives A, Type 8 (miscellaneous) classification, thereby greatly reducing cost and increasing availability of such booster cap assemblies. In the past, booster cap assemblies possessing imperviousness to water desensitization have not possessed good shippability characteristics because in the past booster caps with good resistance to water desensitization were also inherently hazardous in the presence of heat or flame, necessitating shipment under DOT Explosives A, Type 7 (blasting cap) regulations. Similarly, booster caps with good shippability characteristics had inherently poor water desensitization characteristics. Thus, in the past these two desired characteristics have not been compatible. Previous attempts to combine both of these characteristics in a booster cap have resulted in caps containing neither excellent resistance to water desensitization nor good shippability characteristics. For example, by inserting a blasting cap into the booster, a small degree of water tightness was provided in Graham, U.S. Pat. No. Re. 28,228.

It has also been known to provide a small vent hole in an otherwise enclosed booster cap to allow outgassing and venting when subjected to fire. However, such booster caps had poor water resistance. Thus, both of the aforementioned teachings were subject to either complete or partial desensitization through water invasion. A need exists for a blasting cap booster that is water-tight, but when subjected to fire or excessive heat will not explode.

SUMMARY OF THE INVENTION

According to the invention an improved booster cap assembly is provided which possesses both excellent resistance to water desensitization and will also allow the explosive in the booster cap to outgas and burn when heated and thereby prevent the booster cap from detonating when heated or subjected to fire.

The high degree of water resistance is achieved through the use of a sealing plug which protects the detonable composition in the booster cap at high water pressures. Similar booster caps, not containing the sealing plug, are subject to partial desensitization or complete dudding through water invasion of the otherwise detonable material. The length of time which the unprotected booster cap may remain in a borehole containing water and retain sensitivity is comparatively short. In contrast, the booster cap of this teaching has the capability to remain in a deep water filled borehole indefinitely. The reliability of adequate initiation of a column of explosives in a borehole is markedly improved. In addition, safety hazards associated with the necessity for removal of unexploded material from a muck pile, for example, following a blast in which initiation failures occurred in one or more explosive columns, is markedly reduced. Furthermore, the booster cap possesses characteristics such that when subjected to fire or excessive heat, the booster cap will outgas and burn but will not detonate.

The sealing plug inserted in the open end of the booster cap assembly thus has a dual purpose. The sealing plug possesses sufficient structural rigidity to seal in and protect the detonable charge within the booster cap against invasion by water under high pressure, yet possesses physical properties such that in an accidental fire or under excessive heating the sealing plug will soften thereby becoming deformable under pressure exerted by the gases of the slowly decomposing explosive to unconfine the detonable charge material and allow outgassing and subsequent burning of said material without detonation. Thus, according to the invention, the sealing plug used in the cap booster must be a thermoplastic material which will effectively seal the explosive in a water tight relationship within the blasting cap booster but will deform between the decomposition and initiation temperatures of the explosive contained in the booster to vent the confined area to the atmosphere.

BRIEF DESCRIPTION OF THE DRAWINGS

This invention can be more easily understood from a study of the drawings in which.

DETAILED DESCRIPTION OF THE INVENTION

Figure 1:
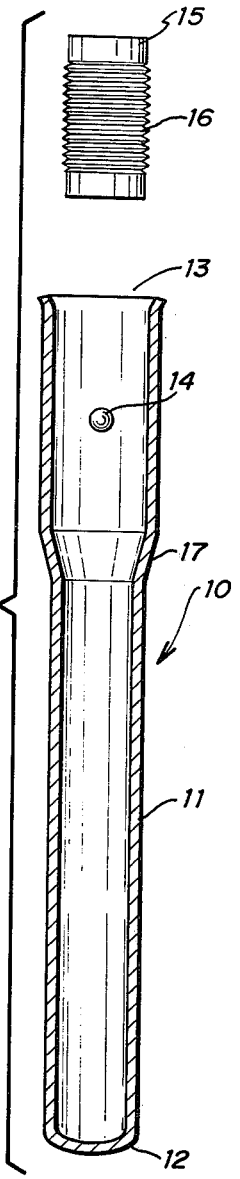
FIG. 1 is a partially exploded sectional view of a blasting cap booster of this invention.

Now referring to the drawings and specifically to FIG. 1, a partially exploded sectional view of the blasting cap booster 10 of the subject invention is schematically shown. As shown the blasting cap booster 10 comprises an elongated tubular cylindrically shaped shell 11 having a closed first end 12 and an open second end 13, the diameter of said second end 13 being larger than the diameter of said first end 12. Single indentation 14 protrudes inwardly from the sidewall of second end 13 of blasting cap booster 10 to permit frictional engagement with a blasting cap when inserted therein as is shown in FIG. 3. Thermoplastic plug 15 has a plurality of circumferential ridges 16 on the exterior thereof and fits in frictional engagement within shell 11 adjacent constriction 17, as will be hereinafter described in connection with FIG. 2. Second end 13 of shell 11 has a larger diameter than first end 12 to facilitate the positioning and insertion of a blasting cap into second end 13 thereof.

Figure 2:
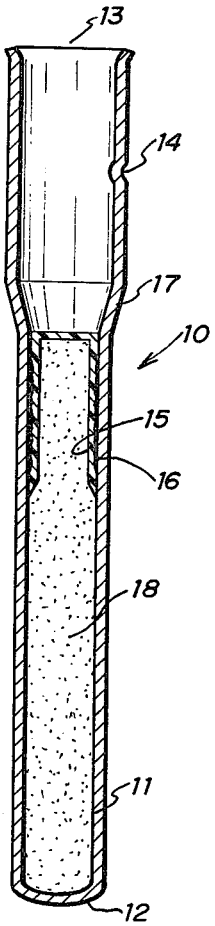
FIG. 2 is a sectional view of a blasting cap booster of the subject invention.
Figure 3:
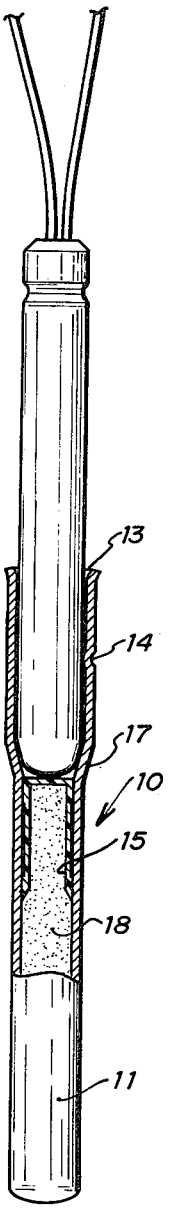
FIG. 3 is a partially sectional view of the blasting cap booster of FIG. 2 with an electric blasting cap inserted into the open end thereof.

FIG. 2 illustrates a sectional view of the preferred embodiment of blasting cap booster 10 shown with detonating charge 18 located in first end 12 of shell 11 and thermoplastic plug 15 coaxially mated with shell 11 by frictional engagement to form a water-tight seal with shell 11. The tops of circumferential ridges 16 located on thermoplastic plug 15 become partially deformed when thermoplastic plug 15 is inserted in place in shell 11 forming water-tight multiple circumferential sealing rings between the interior of shell 11 and thermoplastic plug 15. Shell 11 is large enough to accommodate detonable charge 18 which is usually present in an amount of from about 1–6 grams. Second end 13 is large enough to permit insertion of a blasting cap into shell 11 and constriction 17 prevents further insertion of the blasting cap, as shown in FIG. 3.

FIG. 3 illustrates a partly sectional view of blasting cap booster 10 as shown in FIG. 2, together with an electric blasting cap inserted into open end 13 thereof in frictional fit relationship with indentation 14. While many types of explosives can be used in blasting cap boosters, such as nitrostarch, trinitrotoluene (TNT), tetryl, cyclonite (RDX) and the like, pentaerythritol tetranitrate (PETN) is the preferred explosive for the detonable charge of this invention. According to the invention, primary explosives such as lead azide which detonate rather than combust when exposed to heat in the open atmosphere should not be used as the explosive in the blasting cap booster of the subject invention.

The above-mentioned explosives which are compatible with this invention will detonate if heated to the initiation temperature of the particular explosive in a confined area. However, when any of those explosives are heated under atmospheric conditions, upon reaching its initiation temperature, the explosive outgases and combusts rather than detonates. The aforementioned explosives each have temperatures at which partial decomposition occurs. The decomposition temperature of the explosive would normally be defined as the temperature at which the entire explosive will decompose and is usually a higher temperature than the temperature at which partial decomposition occurs. For purposes of this disclosure, the decomposition temperature is the temperature at which partial decomposition of the explosive occurs. For example, PETN begins to decompose above 100° C.

The thermoplastic material used for thermoplastic plug 15 must have physical properties such that thermoplastic plug 15 has a structural rigidity sufficient to seal and protect detonable charge 18 within shell 11 from invasion by water under high pressure yet have softening characteristics such that the material will soften at a temperature between the decomposition and initiation temperatures of detonable charge 18 so that when detonable charge 18 confined therein begins to decompose, the pressure differential created by the decomposition relative to the confined area of the cap and the atmosphere will cause the plug to deform and unconfine the detonable charge 18 prior to reaching the temperature of initiation of detonable charge 18 confined therein. In the preferred embodiment of this invention thermoplastic plug 15 is constructed of nylon-6,6.

A property called the softening point is useful in mating a thermoplastic to a specific explosive. The softening point is defined as the temperature at which a certain force per unit area penetrates a sample bar a certain distance. One method of determining softening points is found in ASTM Designation D 1525-75, "Standard Method of Test for Vicat Softening Temperature of Plastics." However, softening tests of polymers have, in most cases, an empirical significance and cannot be considered as strictly reproducible in scientifically well established procedure. The results from particular test procedures for determining the softening point of a thermoplastic should be evaluated in terms of that procedure relative to the configuration and size that will be used in the booster cap assembly. Results of softening point tests depend on factors such as time, method of loading and fiber stress. Therefore, actual tests using a particular plug shape and material and explosive should be conducted to insure that the plug has the desired properties. For purposes of this disclosure, the softening point of a thermoplastic is defined as the Vicat Softening Temperature as determined by ASTM Designation D 1525-75.

Generally, a plug which deforms and permits outgassing of the explosive contained in the booster cap at a temperature when about 5% of the explosive has decomposed (gasified) will provide adequate results. Satisfactory results can also be related to the pressure differential between the interior of the booster cap and the atmosphere. As the explosive begins to decompose, the pressure in the booster cap increases, the decomposition being caused by the explosive reaching a certain temperature. The thermoplastic plug material should permit deformation of the plug and outgassing of the explosive to occur at a temperature where the pressure in the booster cap is about 10 psi greater than atmospheric pressure.

Care must be taken in the manufacturing of thermoplastic plug 15 so that the softening and deformation characteristics of the thermoplastic employed will not be altered significantly. For example, subjecting the thermoplastic material to multiple extrusions can alter the softening properties of the material.

Furthermore, although other configurations of thermoplastic plug 15 can be used, such as a cylindrical thermoplastic plug without ridges, a cylindrical plug having multiple circumferential serrations is preferred since when the plug engages the capsule in a frictional or interference fit relationship, the water-tight seal is provided by the relatively small area of circumferential serrations in which the stress on the plug is also concentrated in this relatively small area. Thus, when the temperature is increased only the circumferential ridges need to deform for disruption of the water-tight relationship between the plug and shell walls, to allow outgassing of explosives, contained therein.

Thus, the booster cap assembly of this invention is ideal for use under water or in water filled boreholes but will not explode when subjected to fire or excessive heat that may occur during storage, shipment, and the like.

While this invention has been described in relation to its preferred embodiments, it is to be understood that various modifications thereof will now be apparent to one skilled in the art upon reading this specification and it is intended to cover such modifications as fall within the scope of the appended claims.

I claim:

1. A water-proof blasting cap booster adapted to allow insertion of a blasting cap therein that will not detonate when subjected to fire or excessive heat comprising:

(a) an elongated shell having an open end and a closed end, said open end being adapted to permit the insertion and frictional engagement of the end of the blasting cap with said open end;

(b) a detonable explosive contained with said shell;

(c) a thermoplastic plug having a softening point temperature between the decomposition and initiation temperatures of said explosive, coaxially mated within the open end of said elongated shell to provide a water-tight confinement of said explosives under normal conditions but where said plug deforms and said confinement terminates when said blasting cap booster is subjected to a temperature that causes at least 5% of the explosive to decompose.

2. A booster cap as recited in claim 1 further comprising an indentation extending interiorly of the open end of said shell for providing frictional engagement with the end of the blasting cap.

3. A booster cap as recited in claim 2 wherein the detonating explosive is selected from the group consisting of pentaerythritol tetranitrate, cyclonite, nitrostarch, trinitrotoluene and tetryl.

4. A booster cap as recited in claim 2 wherein the elongated shell is cylindrical and the open end of the elongated shell is of larger cross sectional area than said closed end.

5. A booster adapted to fit over the end of a blasting cap which comprises:

(a) an elongated cylindrical booster cap shell having an open end and a closed end with the open end having a larger diameter than the closed end said open end being adapted to slip over the end of a blasting cap;

(b) a booster explosive filling at least the closed end of said booster cap shell;

(c) an indentation means extending interiorly of the open end of said booster cap shell to provide frictional engagement with the end of the blasting cap; and (d) a thermoplastic plug having a softening point higher than the temperature of decomposition of the explosive, said plug having the shape of a cylindrical shell closed at one end, and in coaxial arrangement within the open end of said shell to provide a water-tight confined area for said explosive under normal conditions, but where said plug deforms to vent said confined area to the atmosphere when the pressure in the confined area caused by heating the booster cap is at least 10 psi greater than atmospheric pressure, allowing outgassing of said explosive to the atmosphere.

6. A booster cap as recited in claim 5 wherein the thermoplastic plug has at least one circumferential ridge on the exterior of the cylindrical portion of said plug.

7. A booster cap as recited in claim 5 wherein the thermoplastic plug has a plurality of circumferential ridges on the exterior of the cylindrical portions of said plug.

8. A booster cap as recited in claim 5 wherein the explosive in said booster cap shell is pentaerythritol tetranitrate.

9. A booster cap as recited in claim 8 wherein the amount of pentaerythritol tetranitrate in said booster cap shell is from 1 to 6 grams.

10. A booster cap as recited in claim 8 wherein the thermoplastic plug is made of nylon-6,6.

11. An improved blasting cap booster containing a detonable explosive and of the type having one end and insertable over the end of a blasting cap, wherein the improvement comprises a thermoplastic plug having at least one circumferential ridge, said plug being coaxially mated within the insertable end of the booster cap for providing water-tight confinement of said detonable explosives, said plug having a softening point that allows said confinement to terminate when the pressure in said confinement due to heating the booster cap is at least 10 psi greater than atmospheric pressure thereby allowing outgassing of said explosives to the atmosphere.

12. A sealing plug for insertion into a cylindrical shell blasting cap booster having an explosive contained therein for providing a water-tight confinement of said explosive when said plug is inserted therein, comprising:

(a) a thermoplastic cylindrical shell, said thermoplastic having a softening point that allows said confinement to terminate when the pressure in said confinement due to heating the booster cap is at least 10 psi greater than atmospheric pressure to allow outgassing of said explosive to the atmosphere; said thermoplastic cylindrical shell having a first end and which is closed, a second end which is open and at least one circumferential ridge around the exterior of said thermoplastic cylindrical shell.

13. The sealing plug as recited in claim 12 wherein said plug has a plurality of circumferential ridges.

* * * * *